United States Patent [19]

Marmignon et al.

[11] 4,378,464

[45] Mar. 29, 1983

[54] CABLE FOR PROSPECTING

[75] Inventors: Jean Marmignon, Charbonnieres les Bains; Luc Lebouc, Sartrouville, both of France

[73] Assignee: Les Cables De Lyon, Lyon Cedex, France

[21] Appl. No.: 238,194

[22] Filed: Feb. 25, 1981

[30] Foreign Application Priority Data

Feb. 25, 1980 [FR] France ..... 80 04053

[51] Int. Cl.[3] ..... H01B 7/18

[52] U.S. Cl. ..... 174/105 R; 174/102 E; 174/106 R; 174/107; 174/115

[58] Field of Search ..... 174/102 R, 102 E, 103, 174/105 R, 106 R, 107, 108, 113 R, 115, 126 CP, 36, 705; 57/149

[56] References Cited

U.S. PATENT DOCUMENTS

| | | | |
|---|---|---|---|
| 3,286,022 | 11/1966 | Hvizd, Jr. | 174/105 R |
| 3,482,034 | 12/1969 | Rhoades et al. | 174/102 R |
| 3,758,704 | 9/1973 | Naud | 174/102 E |
| 3,772,454 | 11/1973 | Donecker | 174/115 X |
| 3,773,109 | 11/1973 | Eberline | 174/115 X |
| 4,028,660 | 6/1977 | Pitts, Jr. | 174/115 X |
| 4,079,190 | 3/1978 | Jones et al. | 174/107 X |
| 4,081,602 | 3/1978 | Panire et al. | 174/115 X |
| 4,250,351 | 2/1981 | Bridges | 174/106 R |

FOREIGN PATENT DOCUMENTS 1418554 12/1975 United Kingdom .

*Primary Examiner*—Volodymyr Y. Mayewsky
*Attorney, Agent, or Firm*—Sughrue, Mion, Zinn, Macpeak and Seas

[57] ABSTRACT

A cable for prospecting, said cable including a core of conductor wires (3) surrounded by insulating material (4) and by armour (7, 8) formed by at least one layer of helically wound steel wires. It includes, from its center to its periphery, inside the armour, an axial monofilament (2) made of a polymer that withstands high temperatures, said monofilament forming the insulation of an inner conductor (1), an outer conductor (5) and a sheath (6) made of a thermoplastic substance that withstands high temperatures, said inner conductor serving a different electrical function than said core of conductor wires.

4 Claims, 1 Drawing Figure

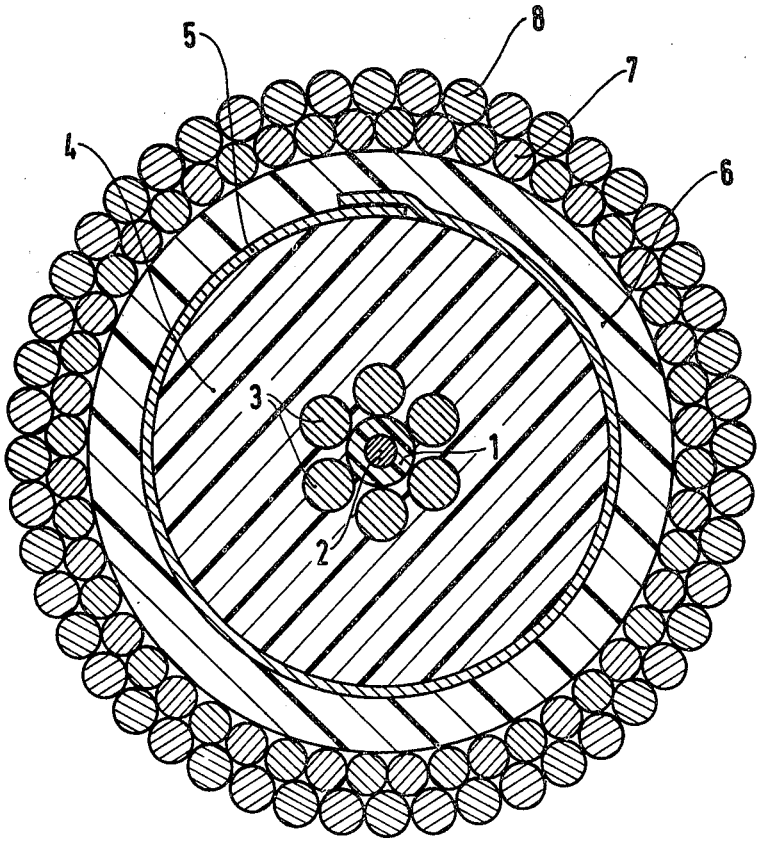
5
8
7
4
6
3
1
2

CABLE FOR PROSPECTING

The present invention relates to a coaxial cable for prospecting, including, from its centre to its periphery:

(a) an axial monofilament made of a polymer that withstands high temperatures;
(b) a plurality of bare conductors;
(c) an electric insulating material that withstands high temperatures;
(d) an outer conductor;
(e) a thermoplastic sheath that withstands high temperatures; and
(f) armour formed by at least one layer of helically wound steel wires.

BACKGROUND OF THE INVENTION

Cables for prospecting, in particular for undersea oil prospecting must withstand ambient pressure, transmit power to control the equipment laid at the bottom and convey to the surface the data which comes from the measuring equipment. Such cables must have high tensile strength and high bursting strength, they must withstand high temperatures and remain insensitive to the action of hydrocarbons which cause many elastomers to swell and which are used to constitute the sheaths of usual cables.

Known prospecting cables of this type include bundles of conductors which are insulated from one another, a flexible casing around the bundles and outer reinforcement formed by two layers of steel wire wound helically in opposite directions. Such cables are incapable of transmitting high-frequency bands and can therefore transmit only a limited amount of data unless they are of large diameter which then entails high manufacturing cost and difficulties in laying.

The present invention aims to remedy the above drawbacks and to produce a cable for oil prospecting which cable simultaneously transmits power and a large quantity of data while it has a relatively small diameter, is not very expensive and is easy to lay.

SUMMARY OF THE INVENTION

In the cable according to the invention the axial monofilament forms the insulation of a conductor whose function is different from that of said bare conductors.

It also preferably includes at least one of the following features:

the conductor insulated by the axial monofilament is a conductor which forms a potential reference;
said axial monofilament and said electric insulating material are made of polymethylpentene, ethylene propylene polyfluoride or polypropylene;
said sheath is made of polymethylpentene, ethylene propylene polyfluoride or polyimide.

BRIEF DESCRIPTION OF THE DRAWING

A coaxial cable in accordance with the invention is described hereinbelow with reference to the sole FIGURE of the accompanying drawing constituting a cross-sectional view thereof.

DESCRIPTION OF PREFERRED EMBODIMENT

The FIGURE illustrates a cross-section of the cable which has an axial monofilament 1 made of a thermostable polymer such as polypropylene, ethylene polyfluoride or propylene, and in particular that marketed by Du Pont de Nemours under the trade name FEP or poly-methylpentene, or that marked by Imperial Chemical Industries under the trade name TPX. The choice of material depends on the operation temperature, FEP being suitable for the highest temperatures. Other polymers such as aromatic polyamides, in particular "Kevlar" marketed by Messrs. Du Pont de Nemours, are also suitable.

The monofilament 1 constitutes the insulation of a conductor 2 which serves to establish a potential reference at each end of the cable, in particular for measuring ground resistance.

The monofilament 1 is surrounded by several bare uninsulated tinned or silvered copper wires 3 which form the inner conductor of the coaxial cable. These wires are themselves sunk in insulating material 4 which withstands high temperatures and is made of the same substance as the monofilament 1. The outer conductor 5 is formed by winding a tinned or silvered copper strip around the insulating material 4. The edges of the strip 5 overlap and are bonded to each other.

The outer conductor 5 is surrounded by a sheath 6 made of a thermoplastic substance that withstands high temperatures. For example, this substance may be polymethylpentene, ethylene propylene polyfluoride or a polyimide such as that marketed by Messrs. Du Pont de Nemours under the trade mark "Kapton". The sheath is protected by armour of steel wires which have high mechanical strength. The armour is constituted of two layers 7, 8 of wire helically wound in a long pitch and in opposite directions.

This armour improves the tensile strength and the bursting strength of the cable. It withstands corrosion by sea water and prevents the sheath from swelling under the action of hydrocarbons.

The coaxial structure of this cable makes it possible for it to transmit high-frequency bands and therefore convey a larger amount of data than known cables of equal diameter.

Although the cable which has just been described with reference to the FIGURE appears to be the preferable embodiment of the invention, it will be understood that various modifications can be made thereto without going beyond the scope of the invention, it being possible to replace some of its components by others which can perform an analogous technical function. In particular, if the surface of the cable is not subject to very severe mechanical stresses, an outer sheath can be added around the armour to protect the armour from corrosion.

The cable in accordance with the invention can be applied in particular to prospecting for oil or natural gas, but it is generally suitable for any searching at the bottom of holes drilled in the ground, in the sea bed or in the bed of a lake.

We claim:

1. A coaxial cable for undersea oil prospecting or the like capable of withstanding ambient pressure and high temperature while transmitting electrical power to underseas measuring equipment and electrically conveying data from said measuring equipment to the surface, said cable comprising outwardly from its center;

(a) an axial electrical conductor directly covered by an axial monofilament of polymer and establishing an electrical potential reference at each end of said cable for measuring ground resistance;
(b) a plurality of bare electrical conductors directly contacting and surrounding said monofilament;

(c) a sheath of an insulating material which withstands high temperatures directly contacting and surrounding said plurality of bare electrical conductors;

(d) an outer electrical conductor directly contacting and surrounding said sheath of insulating material;

(e) a thermoplastic sheath which withstands high temperatures directly contacting and surrounding said outer electrical conductors; and (f) an armour formed by at least one layer of helically wound steel wires directly contacting and surrounding said thermoplastic sheath such that said plurality of bare electrical conductors and said outer electrical conductor form said coaxial cable conductor members, carry said electrical power, and function to shield said axial electrical conductor functioning as said electrical potential reference, making it possible for said coaxial cable to transmit high frequency band data signals and to therefore convey significantly large amounts of data.

2. A cable according to claim 1, wherein said axial monofilament and said sheaths are made of one material of the group consisting of polymethylpentene, ethylene propylene polyfluoride and polypropylene.

3. A cable according to claim 1, wherein said sheath is made of one material of the group consisting of polymethylpentene, ethylene propylene polyfluoride and polyimide.

4. A cable according to claim 1, wherein said outer conductor is constituted by a tinned or silvered copper strip whose edges overlap.

* * * * *